US006370931B2

(12) United States Patent
Bennett

(10) Patent No.: US 6,370,931 B2
(45) **Date of Patent: *Apr. 16, 2002**

(54) STAMPING DIE FOR PRODUCING SMOOTH-EDGED METAL PARTS HAVING COMPLEX PERIMETER SHAPES

(76) Inventor: Edward D. Bennett, 1401 S. Ocean Blvd. A902, Pompano Beach, FL (US) 33062

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/328,955

(22) Filed: Jun. 9, 1999

(51) Int. Cl.[7] ..... B21D 28/00; B21K 1/30

(52) U.S. Cl. ..... 72/336; 72/329; 29/893.33; 83/620; 83/687

(58) Field of Search ..... 83/621, 690, 385, 83/386, 465, 395, 392, 687, 620; 72/327, 329, 336; 29/893.34, 893.33

(56) References Cited

U.S. PATENT DOCUMENTS

| | | | | | |
|---|---|---|---|---|---|
| 104,755 | A | * | 6/1870 | Moseley | 83/465 |
| 1,308,178 | A | * | 7/1919 | Kasel | 83/621 |
| 2,111,156 | A | | 3/1938 | Schneider et al. | |
| 3,488,987 | A | | 1/1970 | Stoeckli | |
| 3,554,065 | A | | 1/1971 | Kunz | |
| 3,564,959 | A | | 2/1971 | Harada | |
| 3,570,343 | A | | 3/1971 | Wolnosky | |
| 3,635,067 | A | | 1/1972 | Hanas | |
| 3,842,645 | A | * | 10/1974 | Stevens et al. | 72/344 |
| 3,968,674 | A | * | 7/1976 | Ishida | 72/334 |
| 4,267,753 | A | | 5/1981 | Bennett | |
| 4,774,865 | A | | 10/1988 | Wallis | |
| 4,951,537 | A | | 8/1990 | Bennett | |
| 5,701,776 | A | * | 12/1997 | Cowan et al. | 83/465 |

* cited by examiner

*Primary Examiner*—Kenneth E. Peterson
*Assistant Examiner*—Stephen Choi
(74) *Attorney, Agent, or Firm*—Davis & Bujold, P.L.L.C.

(57) ABSTRACT

A stamping die produces gears or other parts having quality tooth forms or the like from smooth edged metal blanks. A lower portion of the die includes a trim punch, whose perimeter shape corresponds to the shape of the desired part, and a vertically movable stripper plate surrounding the trim punch and having a recess for aligning the blank. An upper portion of the stamping die is vertically movable with respect to the lower portion, and includes a trim die. The trim die has a bore disposed therein complementary to the trim punch. A nest plate is affixed to the underside of the trim die, and has a tapered nest opening that aligns with the die bore. A controllably biased shedder passes through the bore and opening. During operation, a blank is first placed in the recess. A press ram subsequently descends, with the blank becoming sandwiched between the shedder and the trim punch, with a portion of the blank to be trimmed being left unsupported. The press ram then moves further downwards, with the trim punch in effect advancing into the bore and radiused cutting edges of the trim die trimming the blank. The trimmed scrap portions attempt to flow away from the trim punch, but are constrained by the nest plate, whose tapered shape causes the scrap portions to partially flow together, forming a scrap ring, which is removed from the trim punch via the stripper.

15 Claims, 5 Drawing Sheets

STAMPING DIE FOR PRODUCING SMOOTH-EDGED METAL PARTS HAVING COMPLEX PERIMETER SHAPES

FIELD OF THE INVENTION

This invention relates to the production of smooth-edged metal parts, and, more particularly, to the production of smooth-edged metal parts having complex perimeter configurations, such as gears and sprockets.

BACKGROUND OF THE INVENTION

Numerous methods exist today for producing metal parts. One such method is stamping, by which stock material, typically a metal sheet, is fed into a punch press. The punch press, typically via some sort of die and punch arrangement (stamping die), stamps out parts, which can be in the form of "blanks." A blank, an example of which is shown in FIG. 2, is typically a right cylinder solid having a desired perimeter outline and the same thickness as the original metal stock. For example, conventional round washers, which have a simple circular perimeter, are usually manufactured via a stamping process in conjunction with an integral piercing process for providing a center hole. Blanks may be used as parts in and of themselves, or may be used as intermediate articles of manufacture for producing parts from the blanks.

The production of blanks, or more complex parts such as stamped gears or sprockets, is typically carried out either by a conventional stamping process or by a "fine blanking" process.

In the conventional stamping process, the cooperating punch and die produce an initial shearing action after which the blank is severed from the surrounding stock material by fracturing. This results in the stamped gears or blanks having a disadvantageous feature known in the art as "die break." A ridge, known as "shear," extends around the edge of the stamped blank and divides the portion of the blank that has sheared from the portion that has fractured. The fractured portion is the "die break," and is rough and granular in nature. As the thickness of the stock from which the blank is produced increases, so does the problem of die break.

In order to obtain a smooth-edged piece (that is, a blank or gear having a vertical side edge without shear), a secondary operation called "shaving" is, in traditional prior art, required. Besides being an additional manufacturing step, shaving is disadvantageous in that the amount of material being removed is very small, e.g. approximately 0.010 inch, and is typically in the form of metal slivers. These small pieces may be difficult to remove from the manufacturing machine. Another problem with shaving is that if the metal has a yield strength exceeding 60,000 PSI, small tears may form in the side of the blank. In a gear, these tears (which develop in the gear teeth) may make the gear unacceptable for use.

Another disadvantage in producing gears using conventional stamping methods is that the gear teeth may be deformed on the die-side of the gear blank. This deformation is called "die roll" or "pull down", and can exceed 60% of the material thickness.

The problem of die break is largely averted by using the fine blanking process. One such fine blanking machine is disclosed in U.S. Pat. No. 3,570,343 to Wolnosky et al.

Fine blanking is an extrusion process carried out by clamping the blank and stock material in such a manner as to prevent die break when the extrusion punch and die perform the blanking operation. Although fine blanking eliminates the die break portion of the blank, it suffers from substantial drawbacks.

Two of the most serious problems with fine blanking are the need to provide a special press and the slow operational speed of such a press. Typically, the special press is a triple action punch press which operates to provide three required forces: shear pressure, "vee ring" pressure, and counter pressure. The required special press is particularly expensive and must be extremely robust to provide sufficient support to absorb reaction, sudden pressures, and vibration.

Additionally, fine blanking presses must securely clamp both the blank and the stock material from which the blank is stamped. To this end, it has been necessary to provide a special component feature to encircle the area to be blanked out. That special component conventionally comprises an upstanding pointed ridge which serves to engage and bite into the stock material around the area to be blanked out. The ridge is termed a "stinger" and may be embodied in a tooling component known as a blanking die, or may be embodied in a tooling component known as a "stripper," which is utilized to remove the surplus stock material after the stamping or blank has been removed. In either event, the precise location of the stinger and the need to securely clamp the surplus blank material necessarily results in a press which is intricate, expensive, and cumbersome. Also, the use of a stinger requires sufficient surplus stock material to permit the desired clamping, thereby causing waste.

Furthermore, when it comes to producing tooth forms, for gears or sprockets for example, the fine blanking process is limited. As a general rule, for fine blanking, the tooth thickness at the pitch radius should be equal to 60% of the stock thickness. This may be unacceptable. Also, to prevent die break, the roots and crests of the gear teeth must be radiused, and in cases where tooth width approaches a minimum limitation (typically around 40% of stock thickness), die roll at the tips of the teeth will be considerable.

These limitations regarding gear and sprocket production also apply to the conventional stamping methods, and to the GRIP FLOW® brand metal stamping apparatus disclosed in U.S. Pat. Nos. 4,267,753 and 4,951,537 issued to the present inventor. As such, it has been necessary to employ secondary, additional operations to produce acceptable gear teeth, e.g. gear hobbing, gear cutting, gear broaching, gear grinding, etc. These methods require expensive machines, skilled labor, high maintenance costs, and operate at limited production speeds.

SUMMARY OF THE INVENTION

Wherefore, it is an object of the present invention to overcome the aforementioned problems and drawbacks associated with the prior art designs.

Another object of the invention is to provide a stamping die that produces metal parts that are extremely true to measurement and that have cut surfaces equal in quality to those which can be machined.

Yet another object of the present invention is to provide a stamping die capable of manufacturing metal parts having complex perimeter edge configurations, such as gears, sprockets, and gear racks.

Another object of the invention is to provide a stamping die for producing gears, sprockets, and the like, having straight sided, uniform gear teeth.

Still another object of the present invention is to provide a stamping die that eliminates the need for metal shaving, and that can be configured to reduce mess and stamping die contamination, both of which limit production speed.

To attain these and other objects, the present invention provides a stamping die that produces gears or other parts having quality tooth forms with smooth and straight edges. The parts are preferably made from pre-stamped, smooth edged metal blanks having substantially the same diameter as the parts to be manufactured.

A bottom portion of the stamping die includes a non-moving trim punch whose perimeter shape corresponds to the shape of the desired part. The trim punch extends through a complementary shaped opening provided in a biasable stripper plate, which surrounds the trim punch and is vertically moveable with respect thereto. The stripper plate further includes a recess surrounding the trim punch for aligning the blanks.

An upper portion of the stamping die is precisely aligned and vertically moveable with respect to the lower portion. The upper portion is mounted to the punch press ram. Connected to the underside of the upper portion is a trim die. The trim die has a concentric bore disposed therethrough whose perimeter is also in the shape of the desired part. The trim die bore is aligned with the trim punch, and there is only a minimal radial clearance between the two (i.e. the trim die bore is dimensioned to allow the trim die bore to enter therein with a minimal radial clearance). A downwardly facing edge of the bore perimeter is radiused in diametral cross-section, and forms a trimming or cutting edge. A nest plate is affixed to the underside of the trim die, and has a tapered nest opening that aligns with the trim die bore. The perimeter shape of the opening corresponds to an outer diameter of the blank. A controllably pressure spring biased shedder passes through the bore and opening and extends just beyond the underside of the nest plate. Also, respective piercing features may be provided for facilitating a piercing operation.

The minimal clearance between the trim die bore and the trim punch, is preferably, in the case of a circular blank, a radial clearance of from about 0.0003 inch to about 0.001 inch, for example, for a blank thickness of about 0.125 inch to about 0.375 inch, respectively. This radial clearance may be, typically, no more than about 1% of the stock thickness.

The radiused edge of the die bore, normal to the longitudinal axis of that bore and the edge on the diametral curve of the bore, preferably has a radius of from about 0.005 inch to about 0.025 inch depending on the type and thickness of the stock material.

The opening of the nest plate has a radial clearance from the trim punch, preferably of from about 0.001 inch for a relatively small diameter blank (e.g. 1 inch) to about 0.005 inch for a relatively large diameter blank (e.g. 6 inches), During operation, a blank is first placed in the recess. The punch press ram subsequently descends, with the underside of the shedder contacting the blank, and the shedder being forced slightly upwards against its spring bias means. The blank is thus sandwiched between the shedder and the trim punch, with the stripper being held clear of the blank by the nest plate. The portion of the blank to be trimmed is thus left unsupported. The punch press ram then moves further downwards, with the trim punch in effect advancing into the bore and the cutting edge of the trim die trimming the blank. The trimmed scrap portions attempt to flow away from the trim punch, but are constrained by the nest plate, whose tapered shape causes the scrap portions to partially flow together, forming a scrap ring around the trim punch.

Once the trimming operation is completed, the punch press ram retracts upwards, and the finished part is ejected from the punch press. Then the stripper, which had been moved downwards upon the action of the downwards traveling nest plate, is raised so as to free the scrap ring from the trim punch.

The present invention relates to a punch and die combination for producing a part from a blank, the combination comprising: a trim die (1) defining a bore (10) with a radiused edge for facilitating metal flow; a cooperating trim punch (5) dimensioned closely to mate with the bore (10); a blank engaging shedder (2) displaceable within the bore (10) for engaging the blank; a stripper (4) encircling the trim punch and displaceable therealong for removing surplus stock after a trim operation; and a nest plate (3) having an aperture for positioning the blank and for preventing material being trimmed from the blank from moving laterally beyond the nest aperture, the nest plate being affixed to one of the stripper and the trim die.

The present invention also relates to a stamping die for producing a part from a blank, the die comprising: a lower portion comprising: a trim punch (5) having a perimeter shape corresponding to a desired perimeter shape of the part; and a stripper plate (4) having an aperture disposed therein complementary in shape to the trim punch perimeter, the stripper plate being aligned with the trim punch and vertically movable with respect thereto such that the trim punch can pass through the aperture; and an upper portion in alignment with the lower portion and vertically movable with respect thereto, the upper portion comprising: an upper die shoe (17); a trim die (1) affixed to the upper die shoe, the trim die having a bore (10) disposed therein, with at least a portion of a lower perimeter edge of the bore being radiused to provide a trimming operation cutting edge, and a perimeter of the bore being complementary in shape to the trim punch; a vertically controllably moveable shedder (2) having a perimeter shape corresponding to the desired perimeter shape of the part, and the shedder passing through the bore (10) and being vertically displaceable with respect to that bore; and a nest plate (3) having a nest aperture disposed therein for positioning the blank and for preventing material being trimmed from the blank from moving laterally beyond the nest aperture, and the nest plate being affixed to an underside of the trim die with the nest aperture being aligned with the bore.

The present invention further relates to a stamping die for producing a part from a blank, the stamping die comprising:

a lower portion comprising: a trim punch (5) comprising an at least partially cylindrical body having a flat top surface and a vertical side wall depending from the top surface, the top surface having a perimeter the same as a desired perimeter shape of the part to be manufactured; and a stripper plate (4) vertically movable with respect to the trim punch, the stripper plate having an aperture disposed therein complementary in shape to the perimeter shape of the trim punch and aligned with the trim punch for the trim punch to pass through the aperture; and an upper portion aligned with and vertically movable with respect to the lower portion, the upper portion comprising: an upper die shoe (17); a trim (1) die affixed to the die shoe, and the trim die having a bore disposed therethrough aligned with and complementary in shape to the trim die, and at least a portion of a lower perimeter edge of the bore being radiused for providing a trimming edge; a nest plate (3) having a nest aperture disposed therein for positioning the blank and for preventing material being trimmed from the blank from moving laterally beyond the nest aperture, the aperture having a perimeter shape the same as the blank and the nest plate having the same thickness as the part, and the nest plate being affixed to an underside of the trim die with the nest aperture being in alignment with the bore; and a shedder (2) complementary in shape to the bore and extending down therethrough and through the opening in the nest plate, the shedder being vertically displaceable with respect to the trim die and the nest plate.

BRIEF DESCRIPTION OF THE DRAWINGS

The invention will now be described, byway of example, with reference to the accompanying drawings in which.

DESCRIPTION OF THE PREFERRED EMBODIMENTS

Figure 1:
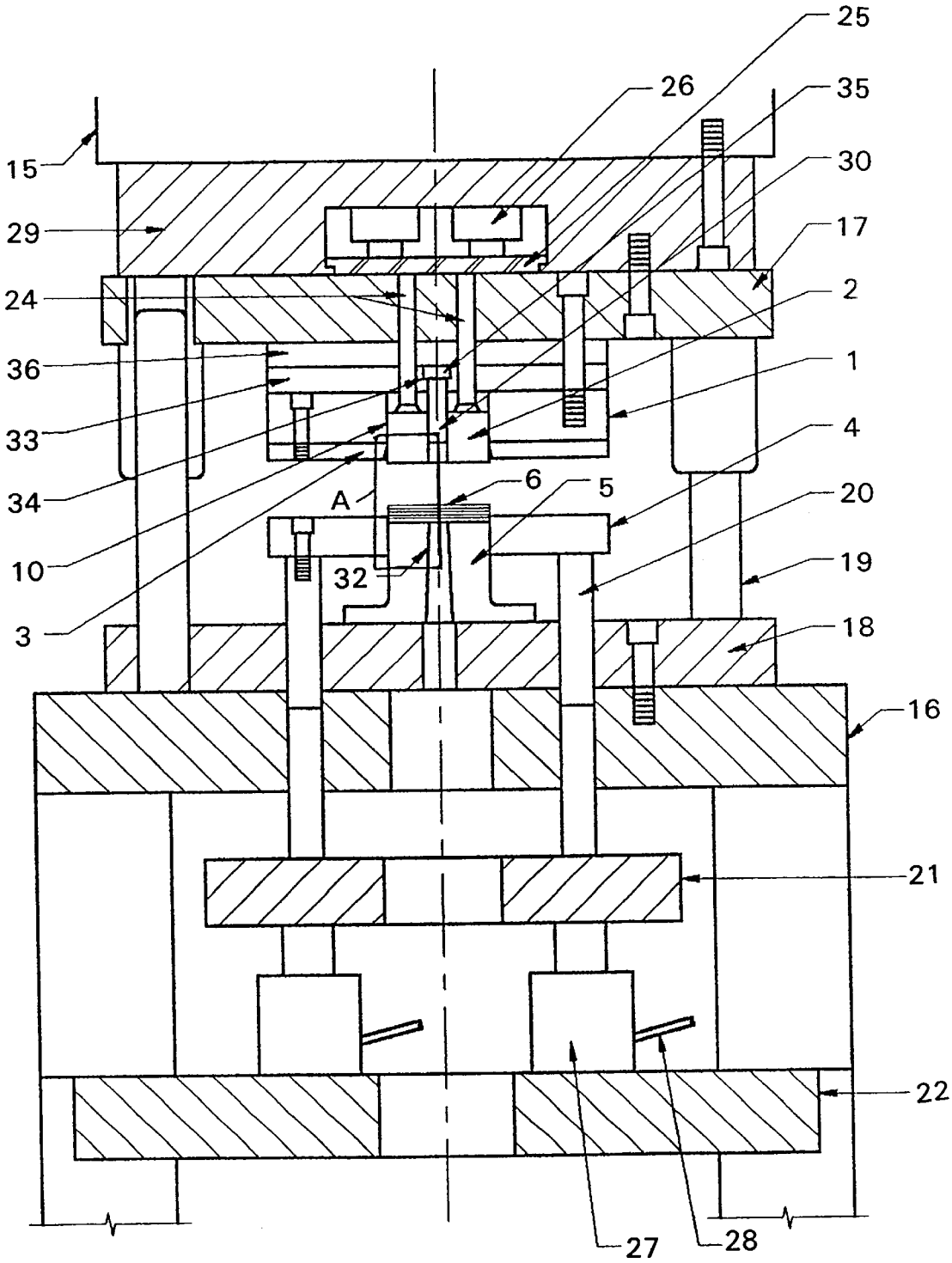
FIG. 1 is a cross-sectional view of a stamping press in which is mounted a preferred embodiment of a precision stamping die according to the present invention.
Figure 2:
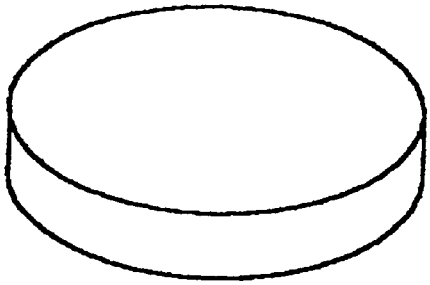
FIG. 2 is an elevational view of a pre-cut blank.

A detailed description concerning the present invention will now be provided with reference to FIG. 1, which illustrates a punch press incorporating a stamping die for effecting a trim and pierce operation. The stamping die serves to both smooth edge trim and smooth edge pierce an article from a pre-stamped blank in a single stamping operation. As will be appreciated, the stamping die of the present invention can be utilized to produce a smooth-edged article having any relatively complex perimeter shape or configuration, simply by providing appropriately shaped component die parts (as discussed in further detail below). However, for the sake of simplicity, the present invention will be primarily described herein with respect to manufacturing gears or sprockets, two common parts having complex perimeter shapes.

To this end, the punch press, preferably hydraulic having controlled punching speed, incorporates a ram 15 movable towards and away from a non-moving punch press bed 16, by means of, for example, a hydraulic cylinder (not shown). An upper die shoe 17 is carried by the ram 15 and a lower die shoe 18 is mounted to the press bed 16. The lower die shoe 18 is securely attached to the press bed by, for example, screws or bolts. In the Figures, similar removable attachment means are shown where various components of the stamping die are to be secured to one another.

The upper die shoe 17 is secured to the ram 15 through the intermediary of a nitrogen spring loaded power pack 29, which in turn is secured to and carried by the ram 15. The power pack 29 has an internal chamber which accommodates a series of nitrogen spring cylinders 26 that bear on a platform 25 to urge the platform downwards into abutting engagement with the top surface of the upper die shoe 17. The power pack 29 arrangement is used to provide a controllable pressure bias on a shedder 2, as discussed below.

In order to ensure that the relatively displaceable component parts of the stamping die are at all times correctly aligned with respect to one another, a plurality of guide posts 19 upstand from the lower die shoe 18 and pass through registering bores in the upper die shoe 17. FIG. 1 of the drawings clearly shows one such post 19 and indicates that at least one other similar post is provided. The cooperating guide posts and bores constrain the upper die shoe 17 (and elements affixed thereto) to move directly toward and away from the lower die shoe, in continuous precise alignment, under the influence of the ram 15.

A trim punch 5 having the same shape of the gears to be manufactured is secured to the lower die shoe 18, and a cooperating trim die 1 is secured to and carried by the upper die shoe 17. As mentioned above, if an item other than a gear was to be produced, the shape of the trim punch and trim die would be varied accordingly.

The trim punch 5 has a concentric bore 32 functioning as a piercing die extending therethrough from top to bottom. A cooperating piercing punch 30 is carried by the upper die shoe 17. To receive the punch 30 a piercing punch plate 33 is provided with concentric bores of different diameters to define a shoulder 34 against which a head 35 of the punch seats. The shoulder 34 prevents ejection of the punch 30 downwardly out of the piercing punch plate 33, and a piercing punch back-up plate 36 prevents movement of the punch in the opposite direction.

The leading edge of the piercing punch 30 passes through the shedder 2 accommodated within a gear shaped bore 10 extending through the trim die 1. The shedder 2 serves to exert a clamping force on a pre-stamped blank 6 to restrain the latter during piercing and blanking operations. The restraining force is asserted by the power pack 29, and is transmitted via the platform 25 and at least two pins 24, which extend through aligned, appropriately dimensioned bores in the upper die shoe 17. As shown in the drawings, the ends of the pins which engage the shedder 2 are flared to present enlarged surfaces for connection to the shedder 2.

While the piercing punch 30 is surrounded by the shedder 2, the shedder 2 is surrounded by a nest plate 3. The nest plate 3 is a metal plate having a central aperture dimensioned to encompass the external periphery of the blank 6 to be trimmed. The thickness of the nest plate 3 should be equal to the thickness of the blank 6. The nest aperture has a tapered lead (as best shown in FIGS. 3–9) that facilitates the positioning of the blank in reference to the cutting face of the die 1. The taper also makes it possible to connect all the individual scrap segments from between the teeth into a solid ring during the cutting process. If this did not occur, there would be a multitude of individual scrap segments to remove from the die area before another part was able to be produced. This would create a number of production problems, not the least of which would be decreased manufacturing speed.

The trim punch 5 is surrounded by a stripper plate 4. The stripper plate has a central aperture dimensioned to encompass the external periphery of the trim punch, and a shallow recess 12 (see FIGS. 4–9) on its top surface for the purpose of locating the blank 6 in relationship to the nest plate 3. The stripper plate 4 is longitudinally displaceable, and can move upwards around the trim punch towards a supported blank under the influence of a biasing spring force. The biasing spring force in this respect is transmitted by at least two spring means 27 which abuts on a fixed platform 22 at one end and on a movable platform 21 at the other end. The spring biased movement of the platform 21 is transmitted to the stripper 4 by a plurality of stripper pins 20 extending through aligned bores provided in the press bed 16 and lower die shoe 18. For simplicity, the drawings show only two such pin members 20. In fact, it is preferred to provide four such stripper biasing pin members, and as many spring bias means as is necessary for proper support and control. The spring bias means 27 can be, for example, hydraulic cylinders, controllable pressure springs, or the like.

Having described the overall structure of the stamping die of the present invention, the operational sequence of the die to perform a trim and piercing operation will now be described with reference to FIGS. 3–9.

Figure 3:
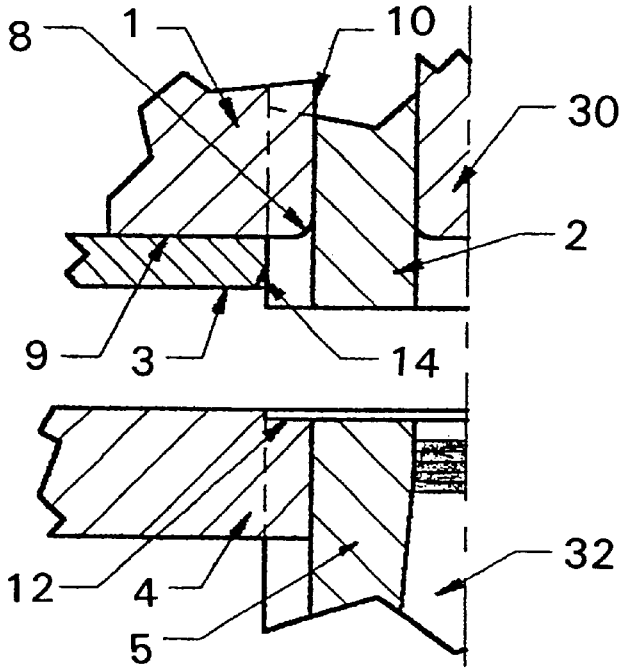
FIG. 3 is a cross-sectional detail view of an area A of FIG. 1, rotated slightly about a center axis of the press to show a minimal cross-sectional area (as is the case with FIGS. 4–9), prior to the placement of a blank in a stripper recess.

At the beginning of an operational sequence, the above described components of the invention occupy the position shown in FIG. 3. That is, the ram 15 is fully withdrawn to its uppermost position to create a maximum gap between the trim punch 5 and the trim die 1.

Figure 4:
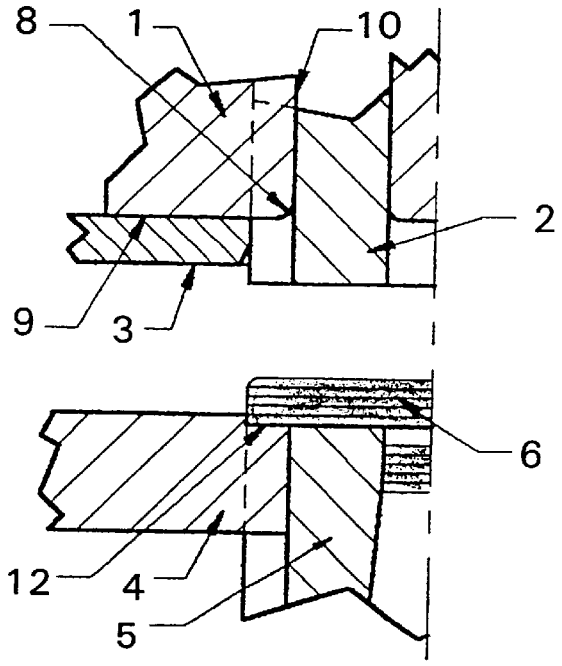
FIG. 4 is a cross-sectional detail view of area A of FIG. 1 after the blank has been placed in the locating recess of the stripper.

As shown in FIG. 4, a blank 6 is subsequently placed into the stripper recess 12. The blank 6 extends over the perimeter edge of the trim punch 5, and its lower surface is below the top surface of the stripper 4. Placement or feeding the blank 6 may be either manually or by a transfer feed arrangement.

The blank 6 should have vertical, smooth-edged sides, and its diameter should be the same as the finished gear. This is so the tips of the gear teeth will not be sheared and the rollover will be less than 15% of the material thickness. Such blanks may be manufactured, for example, according to the aforementioned device disclosed in U.S. Pat. Nos. 4,267,753 and 4,951,537. Blanks produced via a fine blanking operation are not recommended, however, because the fine blanking extrusion process work hardens the cut edges of the blank during the punching operation. Such a blank could be used if it was annealed after stamping, but this would add significantly to manufacturing costs.

Figure 5:
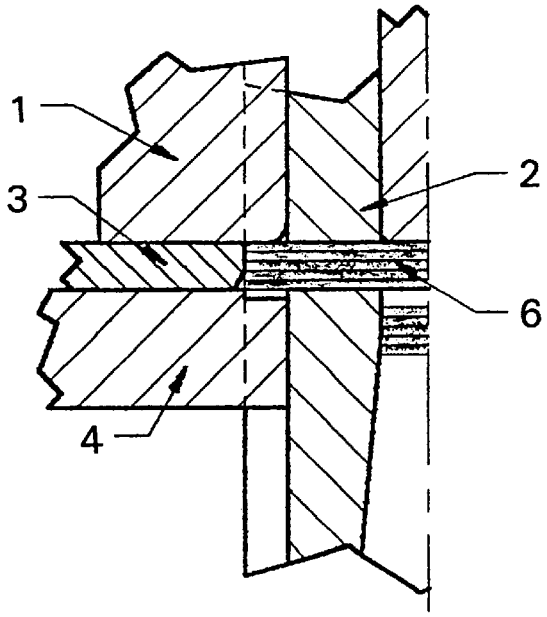
FIG. 5 is a cross-sectional detail view of area A of FIG. 1 during a clamping action.

Turning now to FIG. 5, with the blank 6 in position the controls (not shown) are operated to cause the ram 15 to descend. Upon such descent, a first contact between the relatively movable upper and lower part of the stamping die is made by the underside of the shedder 2 and the uppermost surface of the blank 6. This contact is brought about by dimensioning the component parts of the stamping die so that the nitrogen spring element 26 is in a state of minimum compression. The underside of the shedder 2 stands proud of the underside of the nest plate 3 in the manner shown most clearly in FIGS. 1 and 3. Continued downward movement of the ram 15 and components carried thereby cause the shedder 2 to be forced upwardly, thereby compressing the nitrogen spring elements 26. This compressing action is exerted on the spring elements 26 through the intermediary of the pins 24 and platform 25.

Figure 6:
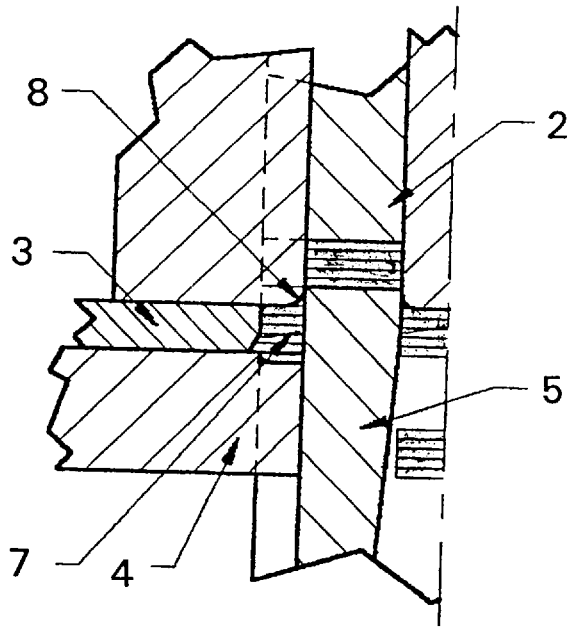
FIG. 6 is a cross-sectional detail view of area A of FIG. 1 during a cutting action.

While the pressure of the shedder 2 causes the blank 6 to be sandwiched in an immovable relationship between the lower surface of the shedder 2 and the top surface of the blanking punch (FIG. 5), the respective punches and dies commence the trim and piercing operation, as shown in FIG. 6.

To this end, the trim punch 5 cooperates with the cutting edges 8 of the trim die 1 defining the gear shaped bore 10. As most clearly seen in FIG. 6, the edges 8 of the die 1 are radiused. The provision of a radiused or rounding on the operating edges of the die 1 is crucial to the provision of a smooth edged stamping.

At this time, the blank is clamped only over the area which will be occupied by the finished gear. With the stripper depressed and held clear of the blank by the nest 3, the scrap material 7 around the edges of the blank is unsupported, and, under the influence of the radiused edges 8, attempts to flow during the advancing of the trim punch 5 into the die bore 10. The scrap material 7, however, is trapped by the nest plate 3, and will extrude into the nest plate's tapered clearance 14, connecting the scrap slugs together for a portion of the gear's thickness.

It is important to remember that only the sides and roots of the gear teeth are trimmed, and not the gear tips themselves. This is because the tips are formed from the original side walls of the blank. Therefore, die rollover in the area of the tooth is minimized and the tips of the gears have no tears.

In order to achieve the desired effect of smooth edged sides, it is not only crucial that the edges 8 of the trim die 1 be radiused, but also that there be minimal radial clearance between the external periphery of the trim punch 5 and the die bore 10 of the trim die 1. Although "minimal" is a relative term, it will be clearly understood in the context of conventional punches and dies, where it is usual to have a clearance between the punch and die equal to approximately ten percent of the thickness of the material to be stamped. In the case of the present invention, the clearance is preferably not more than one percent per side of the thickness of the material to be stamped.

It will be appreciated that the piercing of the blank 6 by the piercing punch 30 and the die bore 32 is also brought about upon downward movement of the ram 15, as shown most clearly in FIG. 3, with the leading edges of the piercing punch 30 possessing an irregular convex configuration (i.e. radiused) to cause metal flow.

Although FIG. 3 of the drawings shows the respective punch and die parts relatively positioned so that the trimming operation effected by the punch 5 and the cooperating die 1 commence simultaneously with the operation of the piercing punch 30 and the die bore 32, it is also possible to position the piercing punch 30 with respect to the die opening 10 so that the trimming operation begins before the piercing operation. The time increment, if any, between commencement of the trimming and piercing operations is governed by the position of the forward end of the punch 30 with respect to the underside and irregular convex (radiused) edges of the die 1.

Figure 7:
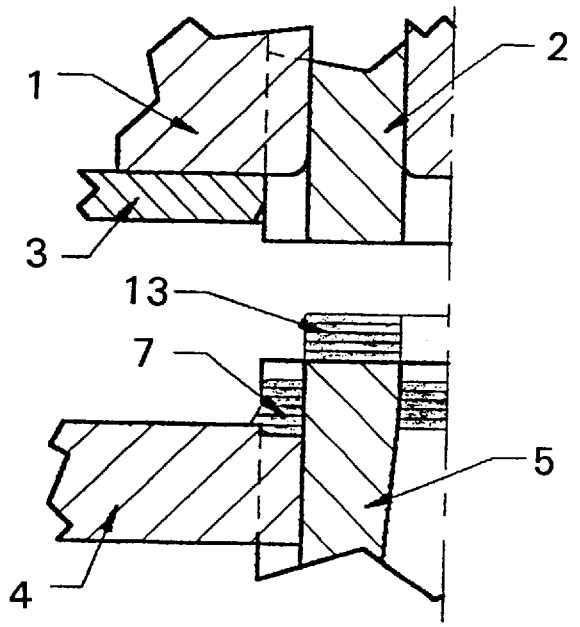
FIG. 7 is a cross-sectional detail view of area A of FIG. 1 subsequent the cutting action and prior to a stamped part being ejected from the tool.

Upon completion of the trimming and piercing operation, the punch press ram 15 is retracted upwardly, the trim die 1 withdraws from the trim punch 5, and the shedder 2 continues to clamp the finished gear 13 (previously the blank 6) to the face of the trim punch 5. As the trim die continues to move upward, the gear 13 is freed from the opening 10. Once the face of the shedder 2 is beyond the face of the nest plate 3 the clamping pressure is released from the gear, as shown in FIG. 7. The pressure on the shedder 2 is obtained from the nitrogen spring pistons 26, which transmit their force through the platform 25 and shedder pins 24.

Figure 8:
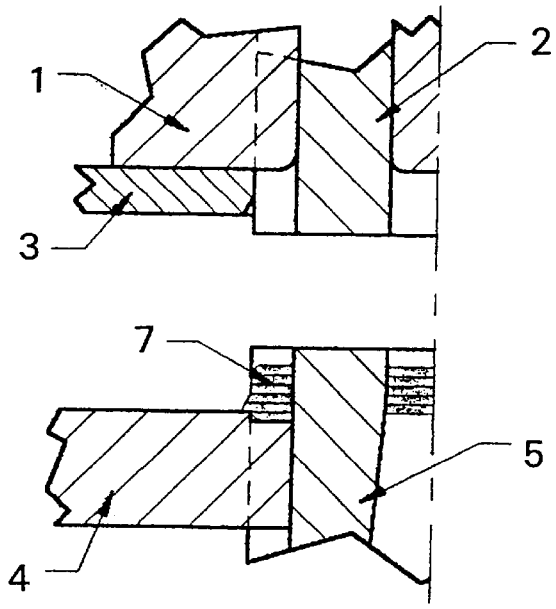
FIG. 8 is a cross-sectional detail view of area A of FIG. 1 subsequent the part being ejected and prior to a stripper moving upward.

Once the shedder 2 is clear of the gear 13, the gear 13 is ejected from the cutting area of the tool, preferably by a blast of compressed air, and only the scrap ring 7 remains, as shown in FIG. 8.

Figure 9:
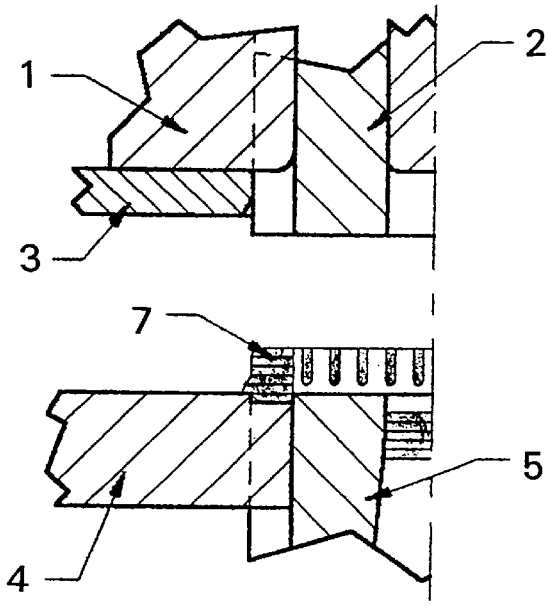
FIG. 9 is a cross-sectional detail view of area A of FIG. 1 after the stripper has moved upward and prior to a scrap ring being removed from the tool.

Turning now to FIG. 9, once the gear 13 is removed from the die area, the stripper plate 4, its movement having been delayed, moves upward to its original position, stripping the scrap ring 7 from the trim punch 5. The scrap ring 7 is then removed by another blast of compressed air. The movement of the stripper plate 4 is controlled by the hydraulic cylinders 27, which transmit their force through the movable platform 21 and stripper pins 20.

Since certain changes may be made in the above described stamping die, without departing from the spirit and scope of the invention herein involved, it is intended that all of the subject matter of the above description or shown in the accompanying drawings shall be interpreted merely as examples illustrating the inventive concept herein and shall not be construed as limiting the invention.

For example, although the present invention has been illustrated with the nest plate being mounted to the trim die, one of ordinary skill in the art will appreciate that the nest plate could be mounted to the stripper plate without departing from the spirit and scope of the invention.

Also, although the nest has been shown as having a taper for the purpose of connecting surplus material, one of ordinary skill in the art will appreciate that the nest could be provided without a taper.

Wherefore, I claim:

1. A punch and die combination for producing a gear wheel having a perimeter profile defining gear teeth including a tip diameter, from a blank of the same diameter as the tip diameter, the combination comprising:

a trim punch (5) having a perimeter profile the same as the perimeter profile of the gear wheel;

a cooperating trim die (1) defining a bore (10) having a perimeter profile complimentary to the perimeter profile of the punch (5), being dimensioned to closely mate with the bore (10) and having a radiused edge (8) to facilitate metal flow, wherein a clearance between the trim punch and the trim die bore does not exceed one percent of a thickness of the blank;

a blank engaging shedder (2) displacable within the bore (10) for engaging the blank;

a stripper (4) encircling the trim punch (5) and displaceable therealong for removing surplus stock after trim operation; and a nest plate (3), in use, clamped between the trim die (1) and the stripper (4), defines an aperture and a tapered lead (14) to the aperture for positioning the blank and for preventing material being trimmed from the blank from moving laterally beyond the aperture and the tapered lead (14); wherein the trim die (1) and trim punch (5) cooperate to trim waste material from between the gear teeth by trimming only sides and roots of the gear teeth without the blank and for preventing material being trimmed from the blank from moving laterally beyond the aperture and the tapered lead (14); wherein the trim die (1) and trim punch (5) cooperate to trim waste material from between the gear teeth by trimming only sides and roots of the gear teeth without changing the tips diameter to produce scrap slugs connected by material extruded laterally by the trimming operation into the tapered lead (14) as a scrap ring removable in one piece by the stripper (4) while leaving the tips of the gear teeth at the tip diameter, the nest plate (3) being affixed to one of the stripper (4) and the trim die (1).

2. The combination according to claim 1 wherein the thickness of the nest plate is equal to the thickness of the blank.

3. The combination according to claim 1 wherein the tapered lead defined by the nest plate also facilitates entrance of the blank into the aperture.

4. The combination according to claim 1 wherein a recess is disposed in a top surface of the stripper for positioning the blank in proper relationship to the trim die bore.

5. The combination according to claim 1 wherein the nest plate is substantially the same thickness as the blank.

6. A stamping die for producing a toothed part having teeth including teeth tips, from a blank having a profile defining the teeth tips, the stamping die comprising:

a trim punch (5) having a perimeter profile the same as the perimeter profile of the part;

a cooperating trim die (1) defining a bore (10) having a perimeter profile complimentary to the perimeter profile of the punch (5), being dimensioned to closely mate with the bore (10) and having a radiused edge (8) to facilitate metal flow, wherein a clearance between the trim punch and the trim die bore does not exceed one percent of a thickness of the blank;

a blank engaging shedder (2) displaceable within the bore (10) for engaging the blank;

a stripper (4) encircling the trim punch (5) and displaceable therealong for removing surplus stock after trim operation; and a nest plate (3), in use, clamped between the trim die (1) and the stripper (4), defines an aperture and a tapered and a tapered lead (14) to the aperture for positioning the blank and for preventing material being trimmed from the blank from moving laterally beyond the aperture and the tapered lead (14); wherein the trim die (1) and a trim punch (5) cooperate to trim waste material from between the teeth by trimming only sides and roots of the teeth without changing the tips of the teeth to produce scrap slugs connected by material extruded laterally by the trimming operation into the tapered lead (14) to be removable in one piece by the stripper (4), the nest plate (3) being affixed to one of the stripper (4) and the trim die (1).

7. The stamping die of claim 6 wherein the thickness of the nest plate is equal to the thickness of the blank.

8. The stamping die of claim 6 wherein the tapered lead defined by the nest plate also facilitates entrance of the blank into the aperture.

9. The stamping die of claim 6 where a recess is disposed in a top surface of the stripper around the stripper aperture for positioning the blank in proper relationship to the nest plate aperture.

10. The stamping die of claim 6 wherein the shedder is resiliently biased.

11. The stamping die of claim 6 wherein a concentric piercing punch bore is disposed in the shedder, a concentric trim punch bore is disposed in the trim punch in alignment with the piercing punch bore, and a piercing punch is in alignment with the piercing punch bore, whereby for a piercing operation, the piercing punch passed through the piercing punch bore and through the blank at least as far as an upper edge of the trim punch bore.

12. The stamping die of claim 11 wherein a cutting edge of the piercing punch is radiused to facilitate metal flow.

13. The stamping die of claim 6 wherein the stripper plate is vertically moveable with respect to the trim punch via the stripper plate being connected to at least one controllable hydraulic cylinder.

14. The stamping die of claim 6 wherein the nest plate and trim die are unitary.

15. The stamping die of claim 6 wherein the nest plate is the same thickness as the blank.

* * * * *